US007172430B2

(12) United States Patent
Kojima

(10) Patent No.: US 7,172,430 B2
(45) Date of Patent: Feb. 6, 2007

(54) MEMORY CARD CONNECTOR WITH ESD PROTECTION AND CARD LOCKING DEVICE

(75) Inventor: Yutaka Kojima, Fujisawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/488,140

(22) PCT Filed: Aug. 23, 2002

(86) PCT No.: PCT/US02/27046

§ 371 (c)(1),
(2), (4) Date: Jun. 20, 2005

(87) PCT Pub. No.: WO03/021719

PCT Pub. Date: Mar. 13, 2003

(65) Prior Publication Data

US 2005/0260866 A1 Nov. 24, 2005

(30) Foreign Application Priority Data

Aug. 31, 2001 (JP) ..... 2001-263750

(51) Int. Cl.
*H01R 12/00* (2006.01)

(52) U.S. Cl. ..... 439/64

(58) Field of Classification Search ..... 439/64, 439/159, 157, 152, 155, 153, 160, 108; 361/754, 361/798

See application file for complete search history.

(56) References Cited

U.S. PATENT DOCUMENTS 6,322,791 B1 * 11/2001 Vadas et al. ..... 424/198.1
6,475,005 B2 * 11/2002 Yu ..... 439/157
6,478,592 B1 * 11/2002 Hu et al. ..... 439/159
6,561,816 B1 * 5/2003 Hanyu ..... 439/64

* cited by examiner

*Primary Examiner*—Alexander Gilman
(74) *Attorney, Agent, or Firm*—Charles S. Cohen

(57) ABSTRACT

A memory card connector includes a housing for receiving a memory card movable in an insertion direction to an inserted position. The housing mounts a plurality of terminals having contact portions for engaging contacts on at least one side of the memory card. A one-piece metal electrostatic discharge (ESD) terminal is mounted on the housing. The ESD terminal includes an ESD portion for engaging the memory card before the contacts on the card engage the contact portions of the terminals, along with a lock portion for engaging the memory card to maintain the card in its inserted position.

13 Claims, 9 Drawing Sheets

MEMORY CARD CONNECTOR WITH ESD PROTECTION AND CARD LOCKING DEVICE

FIELD OF THE INVENTION

This invention generally relates to the art of electrical connectors and, particularly, to a memory card connector.

BACKGROUND OF THE INVENTION

Memory cards are known in the art and contain intelligence in the form of a memory circuit or other electronic program. Some form of card reader reads the information or memory stored on the card. Memory cards are used in many applications in today's electronic society, including video cameras, smartphones, music players, ATMs, cable television decoders, toys, games, PC adapters and other electronic applications. A typical memory card includes a contact or terminal array for connection through an electrical connector to a card reader system and then to external equipment. The connector readily accommodates insertion and removal of the card to provide quick access to the information and program on the card. The card connector includes terminals for yieldably engaging the contact or terminal array of the card.

Such cord connectors may be used in environments wherein an electrostatic potential difference may exist between the memory card and the circuit of the associated electronic equipment due to electricity charged in the connector and/or in the memory card, itself. When the card is inserted into the connector, an electrostatic discharge may occur which could damage the memory stored on the card. These problems have been solved by providing an electrostatic discharge (ESD) terminal on the card connector, the terminal being connected to ground, whereby the ESD terminal discharges the static electricity before the contacts on the card engage the contacts or terminals of the card connector. Examples of such techniques are shown in Japanese Patent Publication No. 2899947 and Japanese Patent Application Laid-Open No. Hei 8-88059. Of course, providing such ESD protection requires the addition of various components, such as the ESD terminals, to the card connector package.

In addition, some card connectors are provided with latches or lock members which are engageable with a latch or lock portion of the memory card, such as a cut-out or notch in a side edge of the card, to prevent unintentional removal or ejection of the card from the connector. Unfortunately, like the ESD terminals, such locking systems require additional components or parts which increase the overall size of the card connector package, when miniaturization and size-reduction have become most desirable in memory card connectors. An example of such a locking system is shown in Japanese Patent Application Laid-Open No. Hei 11-135192.

The present invention is directed to solving these various problems by providing a memory card connector which has a single, one-piece component which is effective to perform a dual function of providing ESD protection as well as locking the memory card in position within the connector. This multi-function component, thereby, reduces the overall size of the connector by reducing the number of components required to perform these functions.

SUMMARY OF THE INVENTION

An object, therefore, of the invention is to provide a new and improved memory card connector which is provided with ESD protection as well as an improved card locking system.

In the exemplary embodiment of the invention, the connector includes a housing for receiving a memory card movable in an insertion direction to an inserted position. The housing mounts a plurality of terminals for engaging contacts on at least one side of the memory card. A one-piece metal electrostatic discharge (ESD) terminal is mounted on the housing and includes an ESD portion for engaging the contacts on the memory card before the card engages the contact portions of the terminals. The ESD terminal also includes a lock portion for engaging the memory card to maintain the card in its inserted position. Therefore, the single or one-piece ESD terminal performs a dual function of providing ESD protection as well as locking the card in the connector.

In one embodiment of the invention, the ESD portion of the ESD terminal is formed by a flange for engaging a top surface of the memory card along an edge thereof. With this embodiment, the top flange helps to hold the card downwardly in the connector.

In another embodiment of the invention, the ESD portion of the ESD terminal is provided by a flange for engaging a side surface of the memory card. The side flange is formed by a short bent spring arm for applying pressure against the side surface of the memory card. In this embodiment, the side flange helps to lock the card in the connector in the event that the card, itself, does not have a lock portion in the form of a notch or the like.

As disclosed herein, the ESD terminal is stamped and formed of sheet metal material, and the lock portion is formed by a flexible locking arm which has a locking protrusion at a distal end thereof. The flexible locking arm extends in the insertion direction of the memory card. The memory card connector herein is adapted for mounting on a circuit board. The ESD terminal includes a foot or tail portion for connection to an appropriate ground trace on the circuit board.

Other objects, features and advantages of the invention will be apparent from the following detailed description taken in connection with the accompanying drawings.

BRIEF DESCRIPTION OF THE ACCOMPANYING DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

Figure 1:
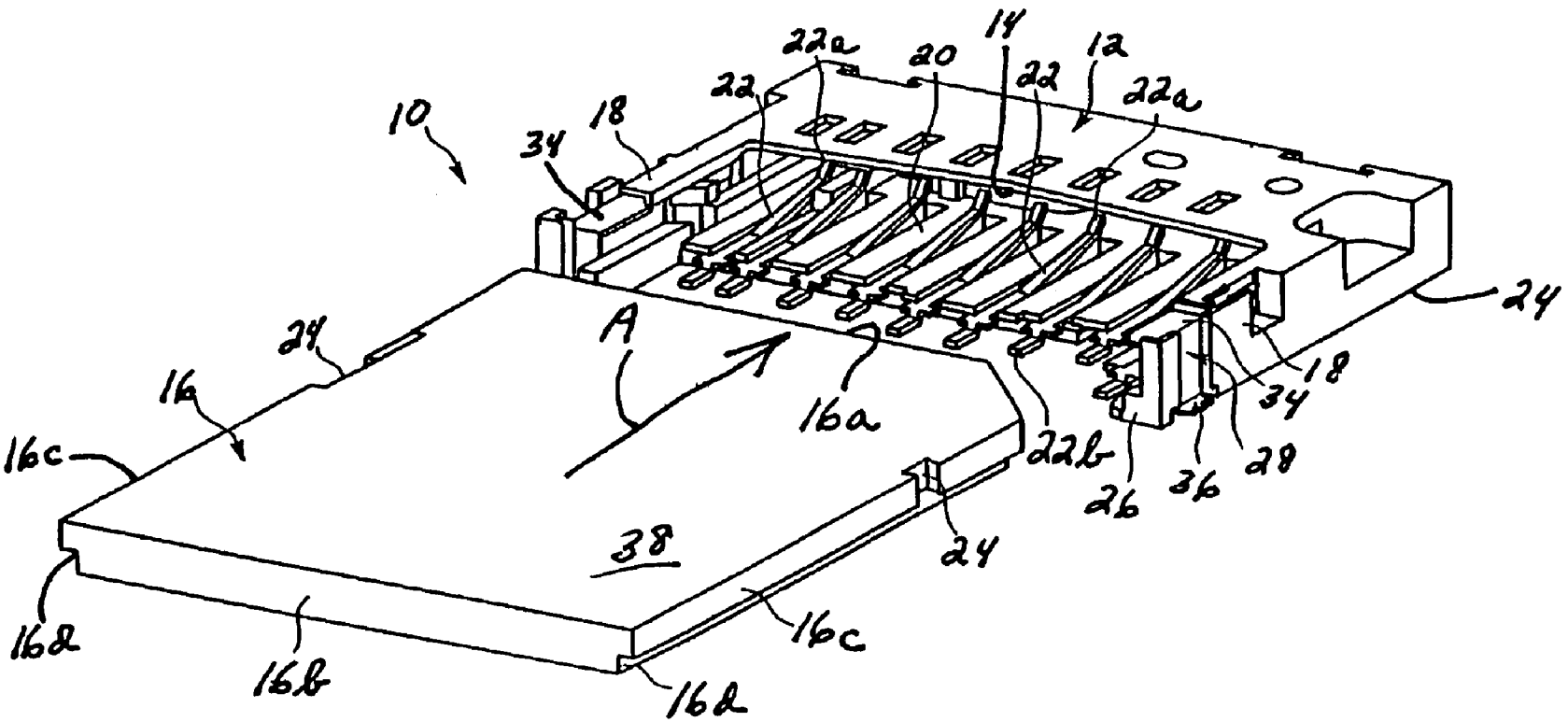
FIG. 1 is a perspective view of a memory card connector incorporating a first embodiment of an ESD terminal according to the invention, with a memory card about to be inserted into the connector.
Figure 5:
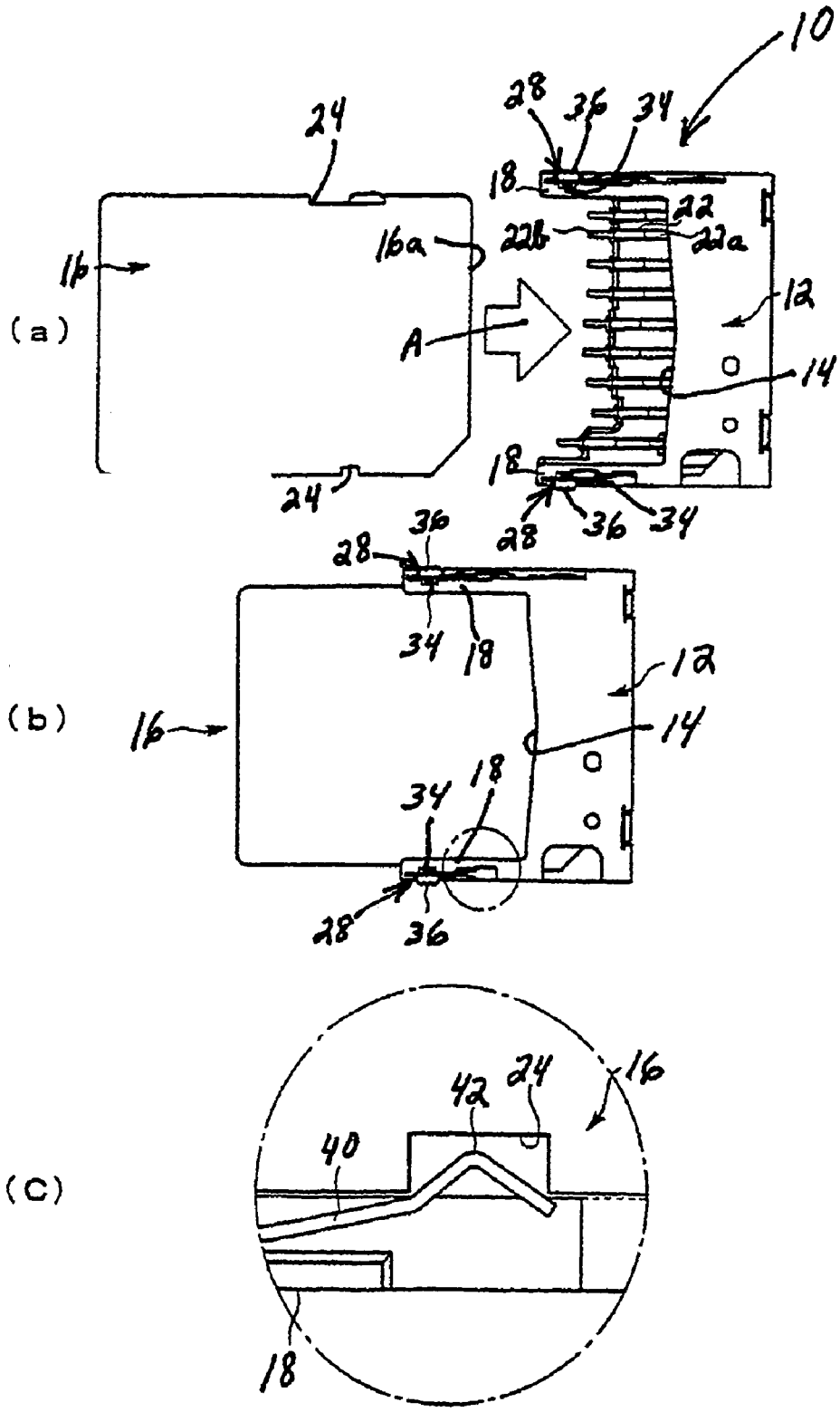
Figure 6:
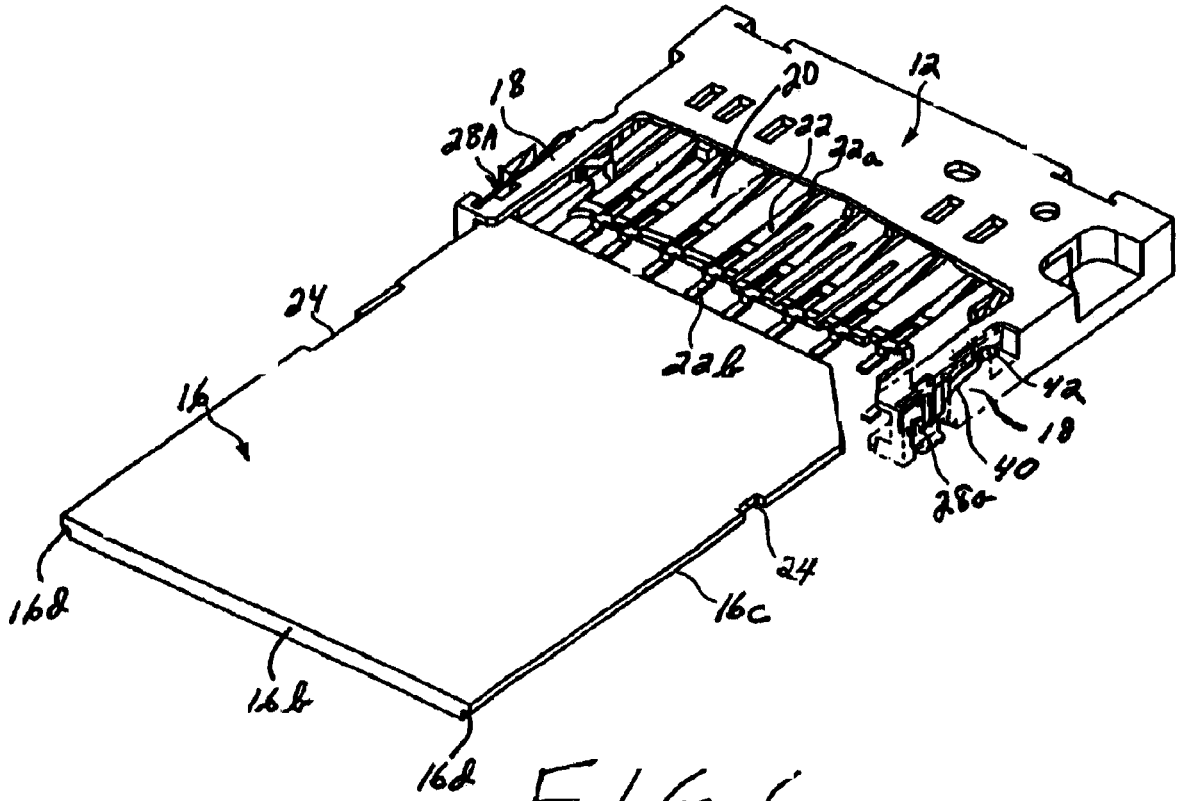
Figure 7:
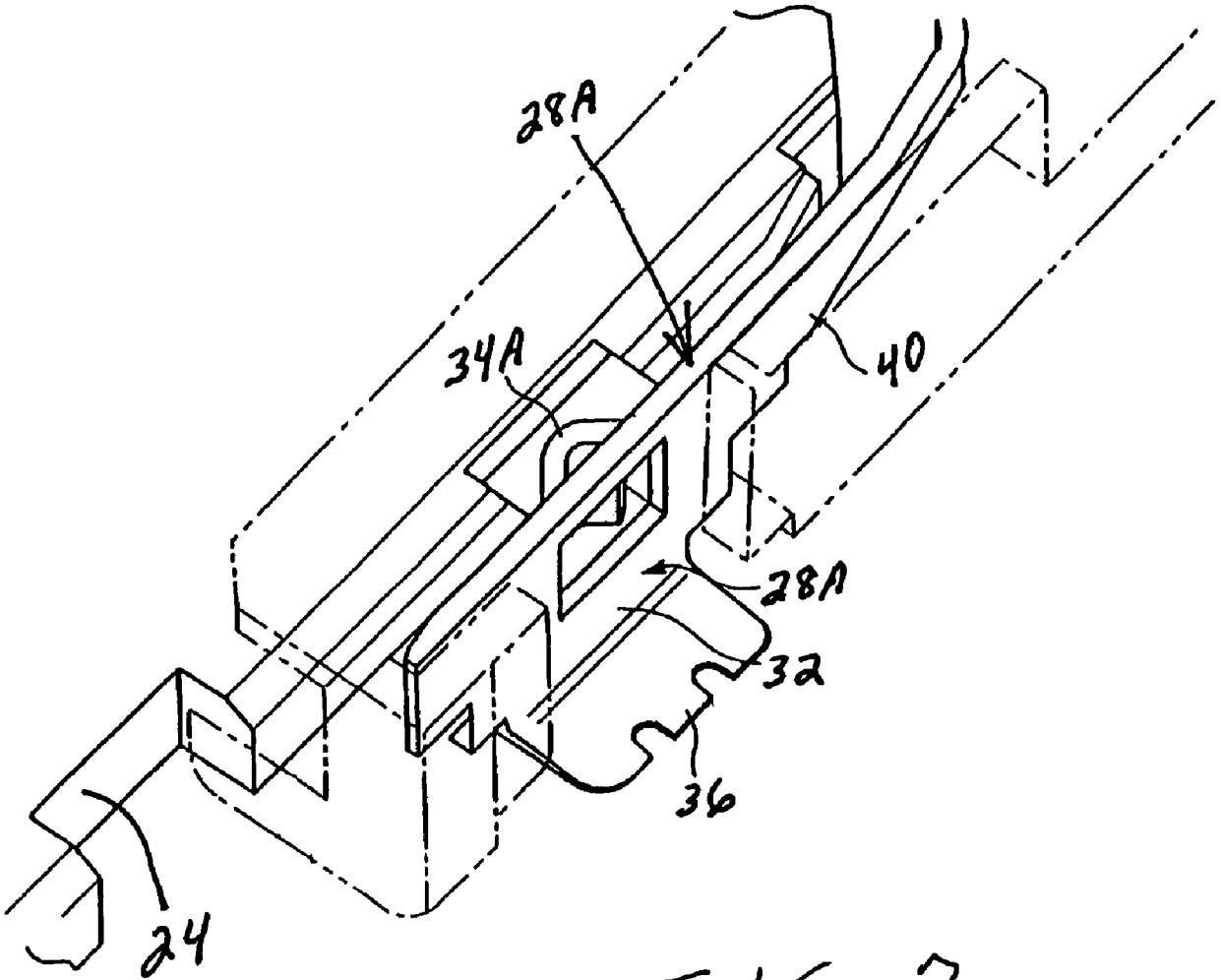
Figure 8:
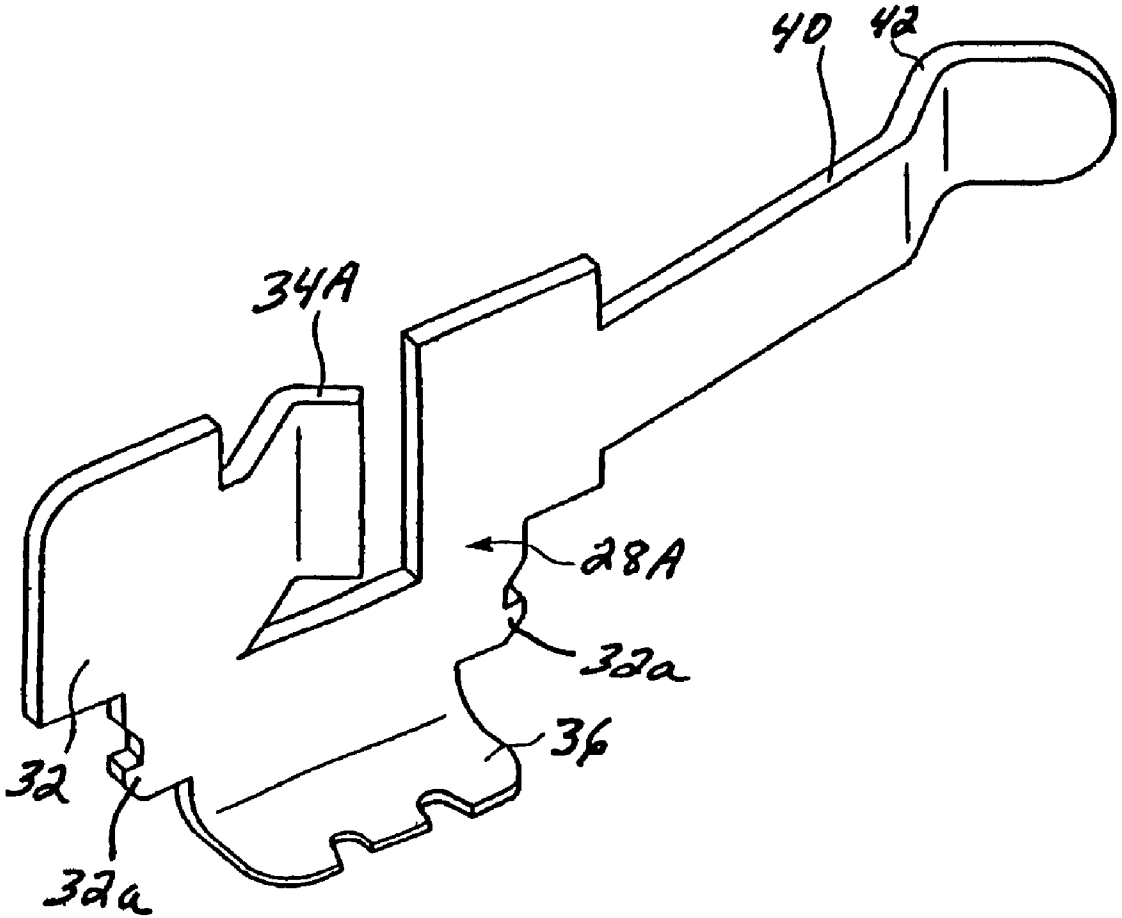
Figure 9:
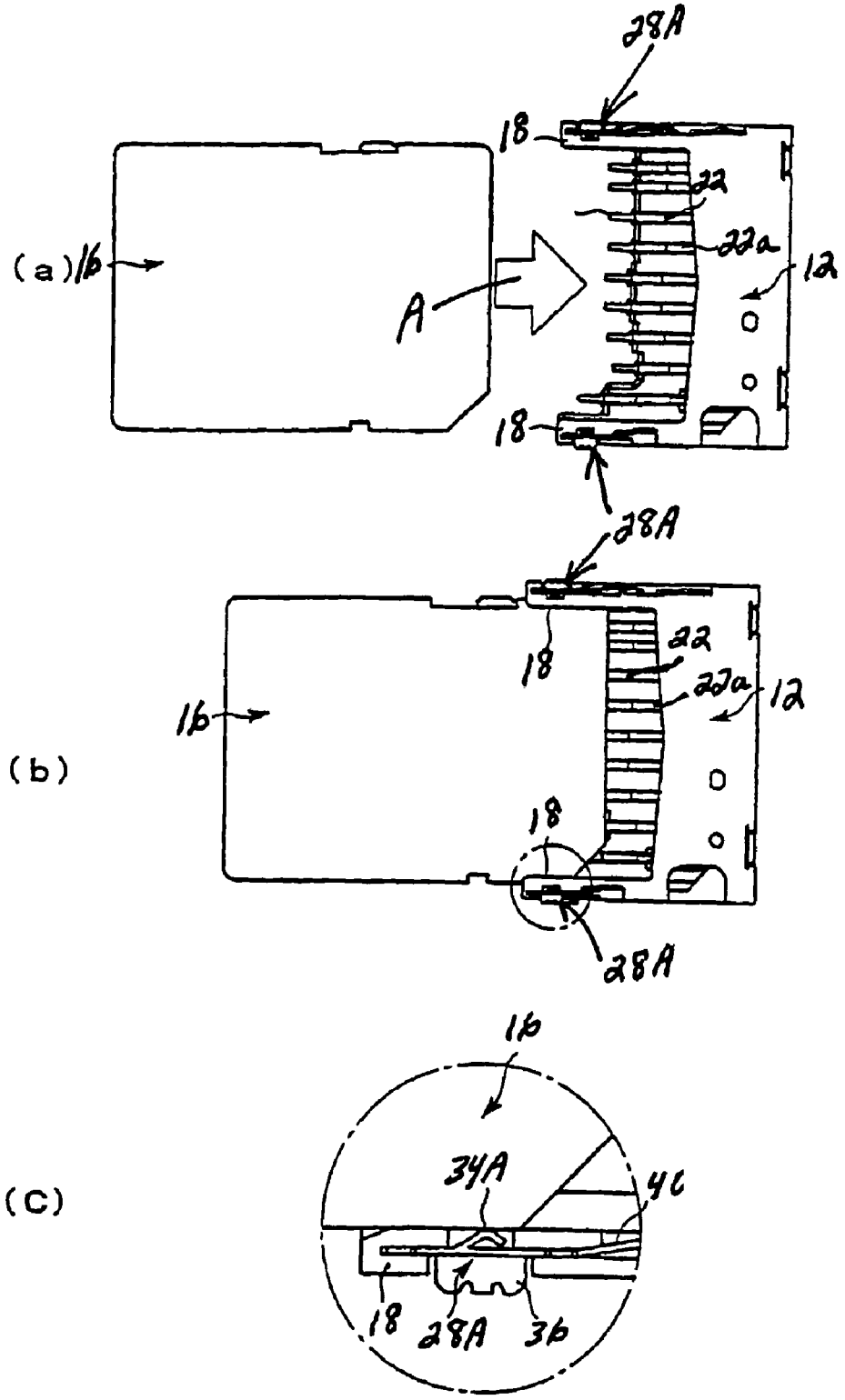

FIGS. 5(*a*)–5(*c*) are various sequential views showing the insertion of the memory card to its inserted, locked position;

FIG. 6 is a view similar to that of FIG. 1, but with the card connector incorporating a second embodiment of an ESD terminal according to the invention;

FIG. 7 is an enlarged, fragmented perspective view of the area of FIG. 7 where the ESD terminal is located;

FIG. 8 is an enlarged perspective view of the second embodiment of the ESD terminal; and FIGS. 9(*a*)–9(*c*) are views similar to those of FIGS. 5(*a*)–5(*c*), but showing the second embodiment of the ESD terminal.

DESCRIPTION OF THE PREFERRED EMBODIMENTS

Figure 2:
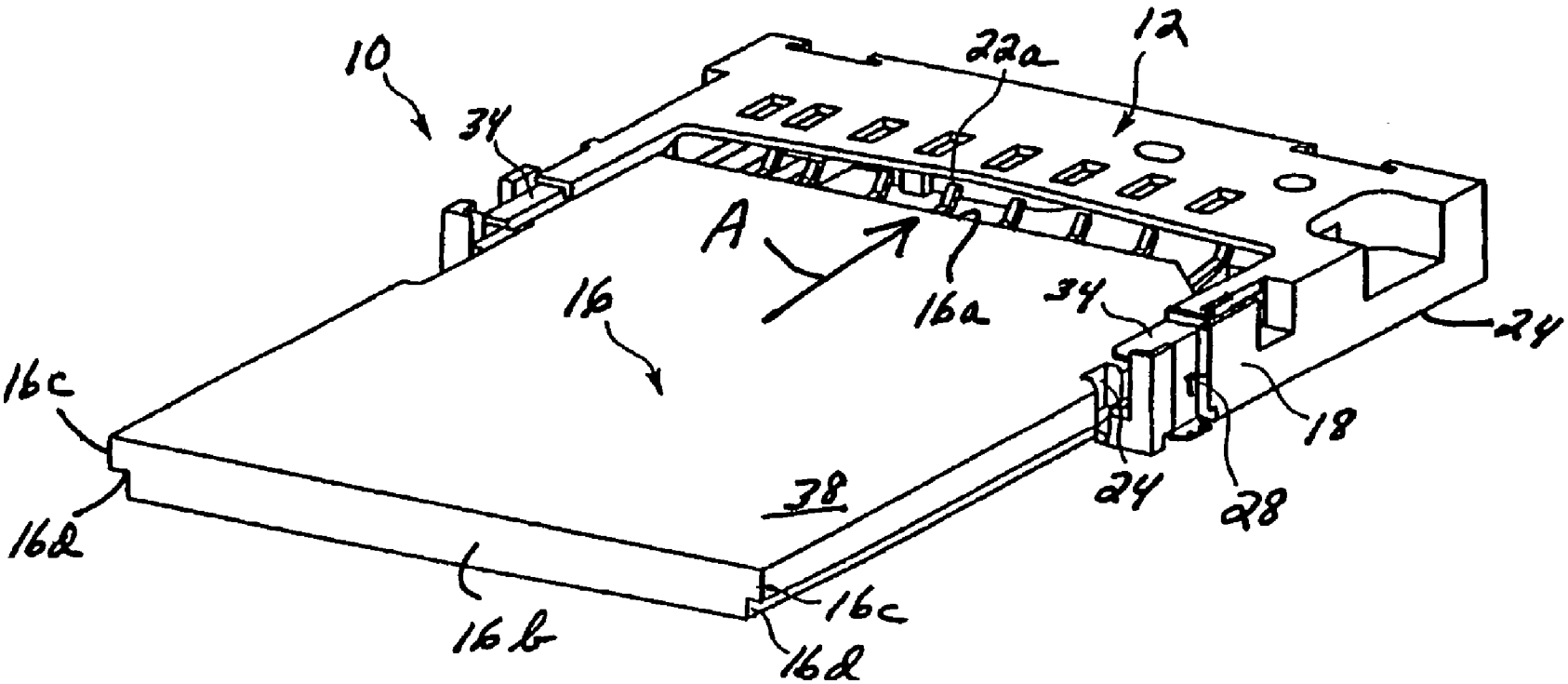
FIG. 2 is a view similar to that of FIG. 1, with the memory card partially inserted into the connector.

Referring to the drawings in greater detail, and first to FIGS. 1 and 2, the invention is embodied in a memory card connector, generally designated 10, which includes a generally rectangular, flat housing, generally designated 12. The housing defines an insertion port 14 for receiving a memory card, generally designated 16, inserted into the connector in the direction of arrows "A".

Housing 12 of connector 10 includes side guiding arms 18 which guide memory card 10 into insertion port 14. The housing includes a terminal mounting portion 20 for mounting a plurality of terminals 22 spaced laterally of insertion port 14. The housing is adapted for mounting on a circuit board (not shown) and includes a bottom mounting surface 24 for positioning onto the board. Each terminal 22 includes a contact portion 22*a* for engaging an appropriate contact on a bottom side of memory card 16 along a front or leading edge 16*a* of the card. Each terminal 22 also includes a foot or tail portion 22*b* for connection to an appropriate ground trace on the circuit board.

In addition to front or leading edge 16*a* of memory card 16, the card includes a rear or trailing edge 16*b* and opposite side edges or surfaces 16*c*. The side edges are cut-out along the lengths thereof, as at 16*d*. Lock portions in the form of notches 24 are formed in the opposite side surfaces or edges 16*c* of the memory card. The side guiding arms 18 of connector housing 12 are formed with inwardly directed flanges 26 which position in cut-out areas 16*d* of the memory card for polarization purposes to prevent the card from being inserted into the connector in an upside-down orientation.

Figure 3:
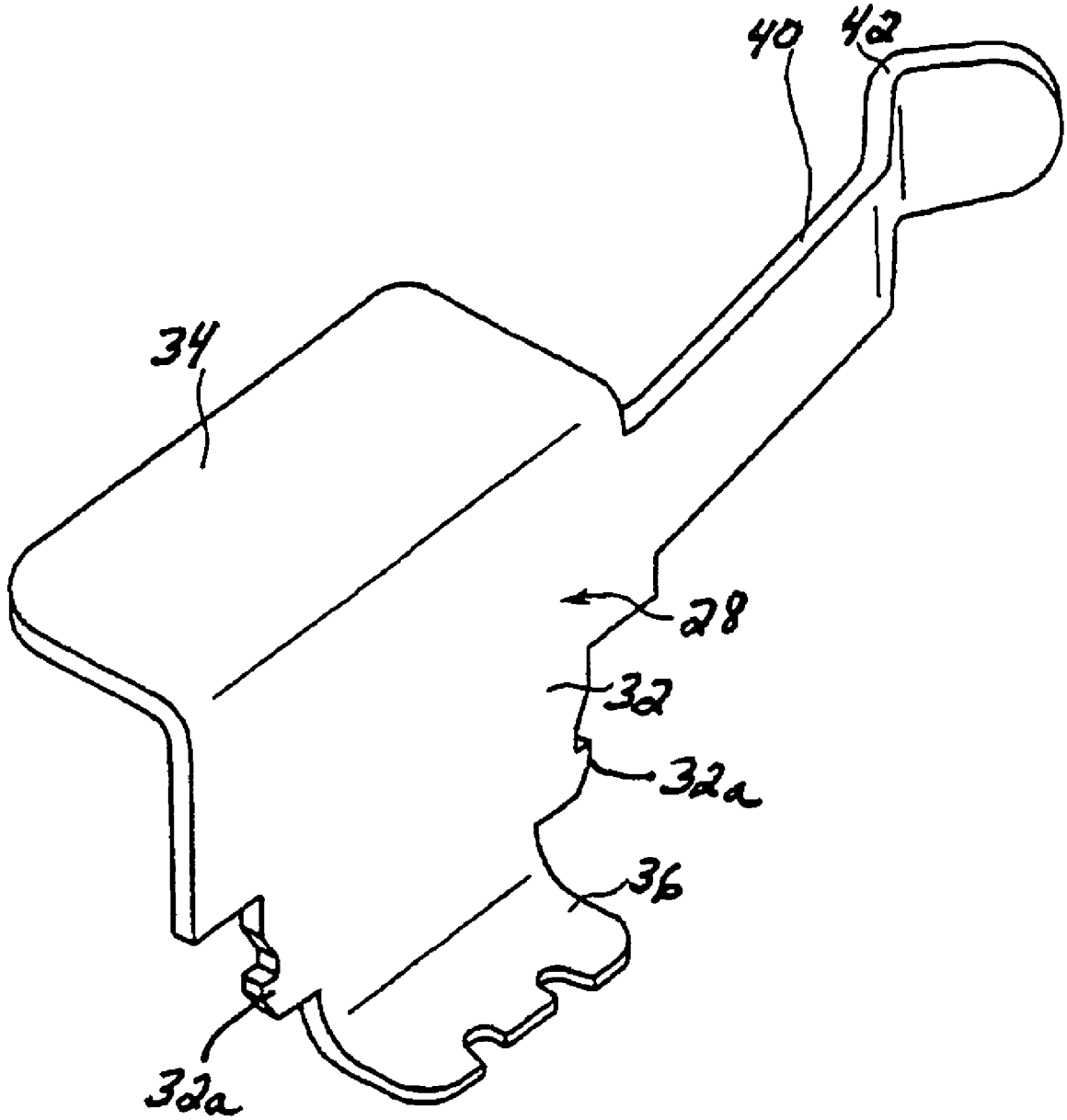
FIG. 3 is an enlarged perspective view of the first embodiment of the ESD terminal.
Figure 4:
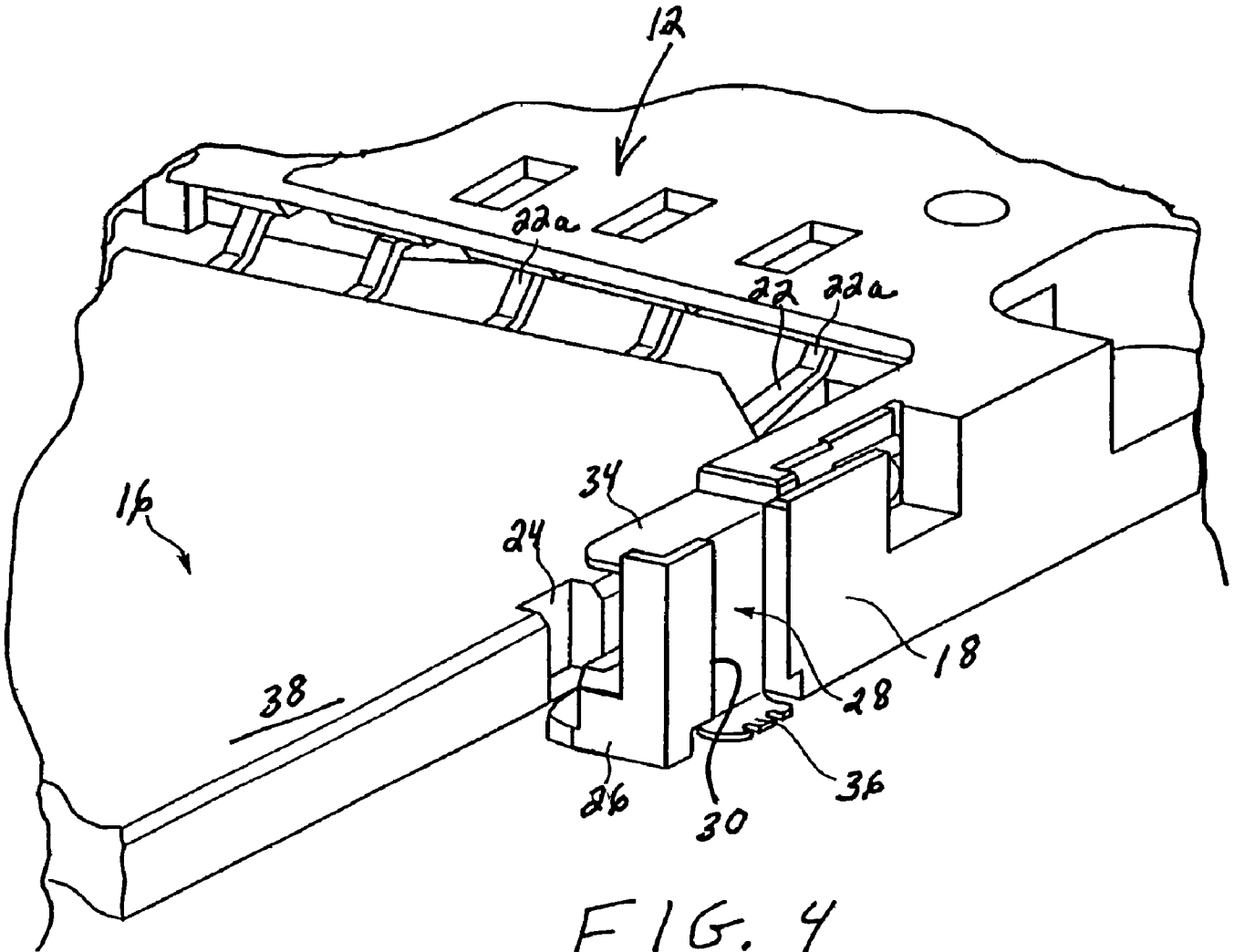
FIG. 4 is a fragmented, enlarged perspective view of the right-hand corner of the assembly shown in FIG. 2.

Referring to FIGS. 3 and 4 in conjunction with FIGS. 1 and 2, an electrostatic discharge (ESD) terminal, generally designated 28, is mounted within a recess 30 in each side guiding arm 18 of connector housing 12. The ESD terminals are stamped and formed of conductive sheet metal material. As best seen in FIG. 3, each ESD terminal 28 includes a planar body portion 32 having an inwardly turned flange 34 at the top thereof and an outwardly turned flange 36 at the bottom thereof. Top flange 34 forms an ESD portion for engaging a top surface 38 of memory card 16. Bottom flange 36 forms a foot or tail portion of the terminal for connection, as by soldering, to an appropriate ground trace on the circuit board. Planar body portion 32 includes teeth 32*a* at the opposite edges thereof for fixing the terminal in recess 30 of one of the side guiding arms 18 of the connector housing. Finally, each ESD terminal 28 includes a flexible locking arm 40 having an inwardly projecting locking protrusion 42 at a distal end of the arm. The flexible locking arm extends in the insertion direction of memory card 16.

FIGS. 5(*a*)–5(*c*) show sequential views of inserting memory card 16 into connector housing 12 in the direction of arrow "A". Specifically, the memory card is inserted between side guiding arms 18 of the connector housing and into insertion port 14 of the housing. When fully inserted, appropriate contacts on the bottom side of the memory card, along leading edge 16*a* thereof, engage contact portions 22*a* of terminals 22 of the card connector. However, before the card contacts engage the connector contacts, top flanges 34 of ESD terminals 28 engage the top surface of memory card 16 and dissipate any electrostatic charges between the card and the connector.

In addition, once memory card 16 is fully inserted into connector housing 12, locking protrusions 42 at the distal ends of flexible locking arms 40 of ESD terminals 28 snap into locking notches 24 of the memory card as seen in FIG. 5(*c*). Therefore, it can be understood that the single one-piece metal ESD terminal 28 performs a dual function of providing ESD protection for the connector as well as locking the memory card in its inserted position within the connector.

FIGS. 6–9 show a second embodiment of an ESD terminal. Like reference numerals have been applied in FIG. 6–9 corresponding to like components described above and shown in FIGS. 1–5 in relation to the first embodiment. A detailed description of those like components will not be repeated.

Suffice it to say, the first embodiment of the ESD terminal 28 shown in FIG. 3 can easily be compared to the second embodiment of an ESD terminal 28A shown in FIG. 8. It can be seen that the difference between the two embodiments of the ESD terminal resides in the fact that the ESD engaging portion 34 (FIG. 3) of the first embodiment comprises the inwardly turned flange. In the second embodiment of FIG. 8, the ESD engaging portion 34A is formed by a short bent spring arm for applying pressure against side surface 16*c* of memory card 16. This is seen in FIG. 9(*c*).

The effective difference between the two embodiments is that with the first embodiment (FIG. 3), top flange 34 engages top surface 38 of memory card 16 and is effective to depress the card and preventing vertical movement of the card during insertion and removal of the card into the connector. If the card has side notches 24, locking protrusion 42 at the distal end of flexible locking arm 40 is quite adequate to lock the card in the connector.

With the second embodiment of the ESD terminal 28A shown in FIG. 8, short spring arm 34*a* provides a considerable force against the side edge of the memory card. This not only increases the positive contact between the ESD terminal and the card to dissipate electrostatic charges, but short spring arm 34A can assist in locking the memory card in the connector. In other words, it may be desirable to use a memory card with connector 10 wherein the card does not have side locking notches 24. With such cards, the inwardly directed forces of short spring arm 34A as well as flexible locking arm and locking protrusion 42 combine to apply inwardly directed locking forces on the side edges of the card. In fact, with two ESD terminals 28A mounted at opposite sides of the connector, four locking points are provided at opposite sides of the memory card.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A memory card connector, comprising:

a housing for receiving a memory card movable in an insertion direction to an inserted position, the housing mounting a plurality of terminals having contact portions for engaging contacts on at least one side of the memory card; and a one-piece metal electrostatic discharge (ESD) terminal mounted on the housing and including an ESD portion for engaging the memory card before the contacts on the card engage the contact portions of said terminals and a lock portion for engaging the memory card to maintain the card in said inserted position, the ESD portion of said ESD terminal comprising a flange for engaging a side surface of the memory card and the flange comprising a short bent spring arm for applying pressure against the side surface of the memory card.

2. The memory card connector of claim 1 wherein the flange of the ESD portion of said ESD terminal is designed to further engage a top surface of the memory card along an edge thereof.

3. The memory card connector of claim 1 wherein the connector is adapted for mounting on a circuit board, and said ESD terminal includes a foot portion for connection to an appropriate ground trace on the circuit board.

4. The memory card connector of claim 1 wherein said ESD terminal is stamped and formed of sheet metal material.

5. The memory card connector of claim 1 wherein the lock portion of said ESD terminal comprises a flexible locking arm.

6. The memory card connector of claim 5 wherein said flexible locking arm has a locking protrusion at a distal end of the arm.

7. The memory card connector of claim 6 wherein said flexible locking arm extends in said insertion direction of the memory card.

8. A memory card connector, comprising:

a housing for mounting on a circuit board and for receiving a memory card movable in an insertion direction to an inserted position, the housing mounting a plurality of terminals having contact portions for engaging contacts on at least one side of the memory card; and a one-piece metal electrostatic discharge (ESD) terminal mounted on the housing and including a flange for engaging a side surface of the memory card before the contacts on the card engage the contact portions of said terminals, said flange comprising a short bent spring arm for applying pressure against the side surface of the memory card, a lock portion for engaging the memory card to maintain the card in said inserted position, and a foot portion for connection to an appropriate ground trace on the circuit board.

9. The memory card connector of claim 8 wherein said ESD terminal is stamped and formed of sheet metal material.

10. In combination with the memory card connector of claim 8, a memory card having a lock portion in the form of a notch in a side edge of the card for interengagement with the lock portion of said ESD terminal.

11. The memory card connector of claim 8 wherein the lock portion of said ESD terminal comprises a flexible locking arm.

12. The memory card connector of claim 11 wherein said flexible locking arm has a locking protrusion at a distal end of the arm.

13. The memory card connector of claim 12 wherein said flexible locking arm extends in said insertion direction of the memory card.

* * * * *